United States Patent [19]

Neuhaus

[11] Patent Number: 4,639,050

[45] Date of Patent: Jan. 27, 1987

[54] TRASH PAIL FOR INSTALLATION IN A CABINET HAVING A SWINGABLE DOOR

[75] Inventor: Josef Neuhaus, Arnsberg, Fed. Rep. of Germany

[73] Assignee: Westermann Kommanditgesellschaft, Arnsberg, Fed. Rep. of Germany

[21] Appl. No.: 634,905

[22] Filed: Jul. 26, 1984

[30] Foreign Application Priority Data

Jul. 30, 1983 [DE] Fed. Rep. of Germany ..... 3327614

[51] Int. Cl.[4] ..... A47B 77/18

[52] U.S. Cl. ..... 312/273; 312/310; 312/329

[58] Field of Search ..... 312/270, 211, 212, 275, 312/271, 310, 329, 290, 291, 309, 327, 273; 211/81, 82, 83; 248/95, 97

[56] References Cited

U.S. PATENT DOCUMENTS

| | | | |
|---|---|---|---|
| 2,247,232 | 6/1941 | Goldberg | 211/83 X |
| 2,457,248 | 12/1948 | Lemke | 312/329 |
| 2,558,939 | 7/1951 | Dornbush | 312/329 X |
| 3,602,568 | 8/1971 | Ingelstorp | 312/329 X |
| 3,922,046 | 11/1975 | Schneider | 312/291 X |
| 3,923,357 | 12/1975 | Eckerle et al. | 312/270 X |
| 4,120,548 | 10/1978 | Manor | 312/270 X |
| 4,304,448 | 12/1981 | Neuhaus et al. | 312/273 |

*Primary Examiner*—William E. Lyddane
*Assistant Examiner*—José V. Chen
*Attorney, Agent, or Firm*—Martin A. Farber

[57] ABSTRACT

A trash pail for installation in a cabinet having a swingable door, the cross section of the upper opening of the pail being closed by a lid which is fastened to one cabinet wall bearing the door hinges and which is moved into the open position upon the opening movement of the door which is coupled with a support for the trash pail. The support, upon the opening of the door, displaces the trash pail out of the cabinet below the lid, which remains within the cabinet. The support is formed as an angle member having arms. Within the angular space of the arms a non-circular corner part of the wall of the trash pail at an upper edge rim of the trash pail is complementarily form-lockingly removably suspended over the upper end edge of the arms of the angle member.

9 Claims, 10 Drawing Figures

TRASH PAIL FOR INSTALLATION IN A CABINET HAVING A SWINGABLE DOOR

The present invention refers to a trash pail for installation in a cabinet having a swingable door, the cross section of the upper opening of the pail being closed by a lid which lid is fastened to that wall of the cabinet which bears the door hinges and is guided into the open position upon the opening movement of the door, the door being coupled with a support for the trash pail, said support, upon the opening of the door, displacing the trash pail out of the cabinet beneath the lid which remains within the cabinet.

Such a development is known from Federal Republic of Germany Utility Model No. 7 911 693 in which the support is developed as an outer pail which receives the trash pail. However, the cost of manufacture is relatively high. Furthermore when the door is open the outer pail extends in disturbing fashion into the area of access to the cabinet, which makes it difficult to clean the region in the cabinet located behind the pail and makes said region also unsuitable for the storing of utensils.

In accordance with the object of the present invention, a trash pail for installation in a cabinet having a swingable door of the type in question is developed in such a manner that, despite secure attachment of the trash pail to the support it does not substantially block access to the inside of the cabinet when the door is open.

SUMMARY OF THE INVENTION

The object is achieved in the manner that the support is developed as a horizontally extending angle iron within the interior angle of which formed by arms a non-round cross-sectional part of the peripheral surface of the traash pail form-lockingly engages.

As a result of this development there is obtained a trash pail of this type which is of increased value in use. On the one hand, the development of the support as an angle iron results in a saving in weight so that the cabinet itself is subjected to less stress. The corresponding saving in material furthermore makes it possible to manufacture and sell the trash pail at a low price. On the other hand, the trash pail is securely held. It finds good support on the angle iron and cannot unintentionally move out of the position into which it has been placed. A further advantage is that, when the door is open and the trash pail removed, the inside of the cabinet is readily accessible. It can be easily cleaned. The good accessibility furthermore provides the possibility of utilizing the space which lies behind the trash pail for the storing of utensils when the door is closed. Furthermore, with a suitable development of the angle iron the trash pail may be of any desired contour.

One additional advantageous development resides in the fact that the rim of the trash pail is hung in form-locked fashion over the upper edge of the angle iron. The trash pail accordingly is inserted from above. In the final phase of the insertion movement, form-locking is then produced between the rim of the trash pail and the upper edge of the angle iron. This means that, seen in plan view, the rim of the trash pail and the upper edge of the angle iron have the same course. The trash pail remains in this form-locked condition as a result of its own weight. As the trash pail is filled this form-lock is even further enhanced.

High stresses can be taken up without damage if the bottom of the trash pail rests on a lower plate of the support which corresponds to the angular space. At the same time this plate also provides stability for the arms of the angle iron which is open towards the top.

The securing of the trash pail in its inserted position can be further improved by providing a form-locked engagement between the lower side of the bottom of the pail and the plate. For example, for this purpose the plate can form an upward-directed elevation which engages behind a corresponding collar on the lower surface of the bottom of the pail.

It is also favorable to provide alongside the upper end edge of the angle iron a cam projection which, when the angle iron is swung out, moves below the rim of the lid which is pivoted around a horizontal axis to the inner wall of the cabinet. The cam projection can be arranged close to the pivot point of the angle iron so that the profile of the angle iron can be made small. Nevertheless, the lid, which is hinged around the horizontal axis to the inner wall of the cabinet, is lifted by a relatively large angle upon the opening of the door.

It is furthermore advantageous for the trash pail, which is of elongated shape as seen in top view, to have its axis of longer length parallel to the door. In this way, better utilization of the inside of the cabinet is possible, particularly in the case of sink cabinets of the type with a centrally located drain.

The angle iron is further stabilized in the manner that it is provided at both its upper and lower ends with a collar which protrudes in direction away from the angle space, the upper collar forming the cam projection and the lower one forming the connection to the door by means of a slot pin connection. Accordingly, the collars perform additional functions.

The fact that at least the vertex of the angular space is rounded also exerts a stabilizing effect. Furthermore, such a course of the arms are configured, in cross section, so as to be in cross sectional direction as is adapted to the shape of the trash pail.

In addition, further stabilization is obtained in the manner that the side edges of the arms form ledges bent at an angle in the direction towards the side surface of the trash pail. These ledges can be used at the same time to support the trash pail.

Finally, another advantageous feature resides in the fact that the ledges of the angle iron widen in downward direction.

Other advantages and details of the object of the invention will be explained in further detail below, with reference to an embodiment shown in the drawing, in which:

DETAILED DESCRIPTION OF THE PREFERRED EMBODIMENT

Figure 1:
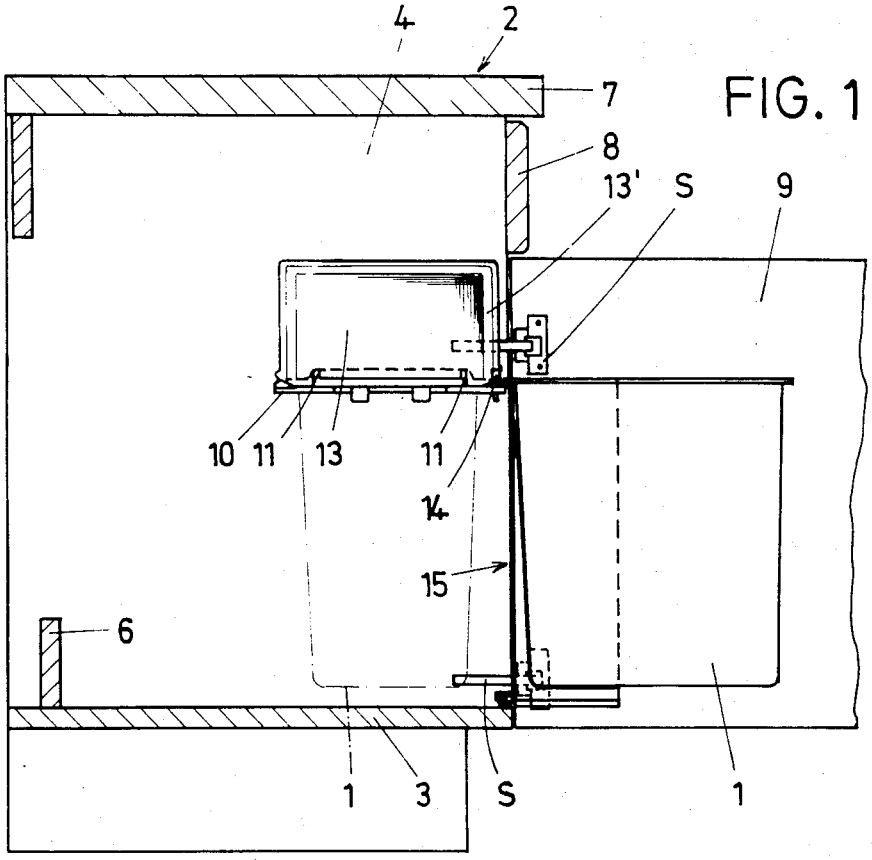
FIG. 1 is a vertical section through a cabinet with the door open, looking at the outwardly swung trash pail and the lid which has been moved into the open position.

The cabinet 2 which receives the trash pail 1 has a cabinet floor 3, cabinet side walls 4, 5, a cabinet rear wall 6, a cabinet cover forming a work top 7 and a mask 8 below the latter. The access cross section which is not covered by the mask 8 can be closed by means of a door 9. The door is mounted on hinges S on the cabinet wall 4.

Figure 2:
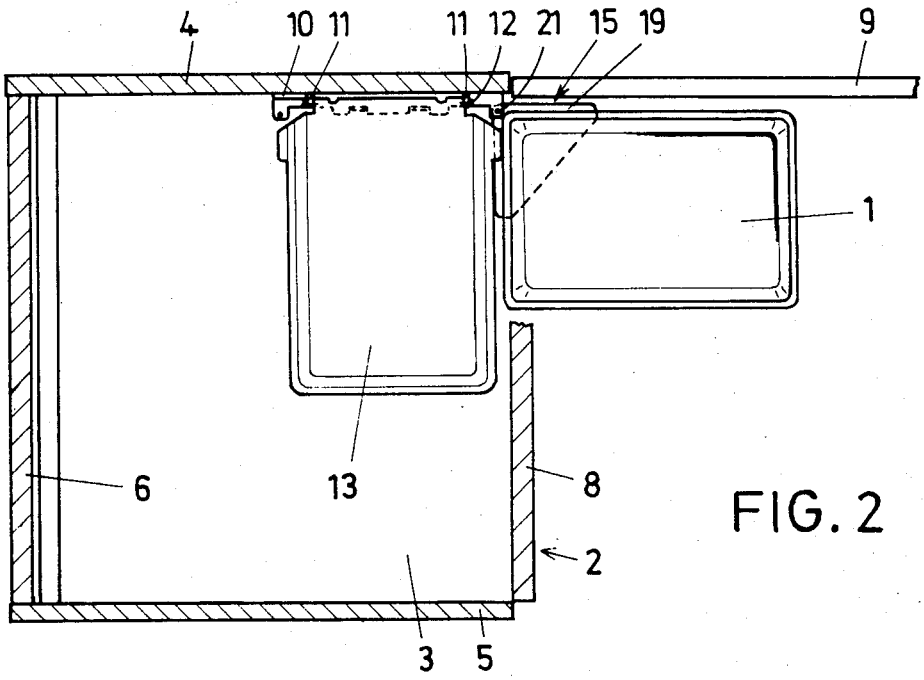
FIG. 2 is a horizontal section through the cabinet above the trash pail, also with the door open.
Figure 4:
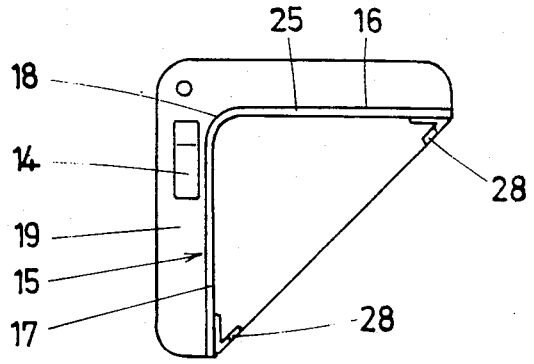
FIG. 4 is a top view of the angle iron, seen in the direction of the arrow IV in FIG. 3.
Figure 3:
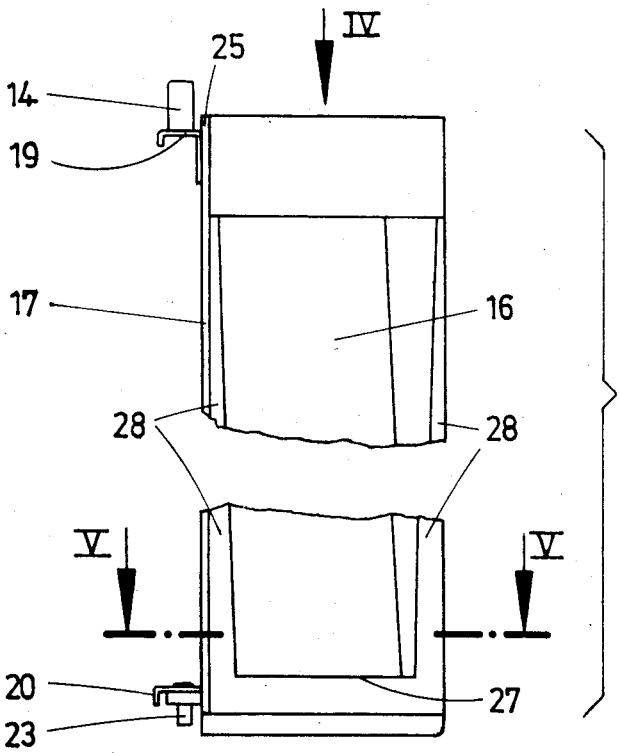
FIG. 3 is a detailed showing of the angle iron which serves to receive the trash pail.
Figure 5:
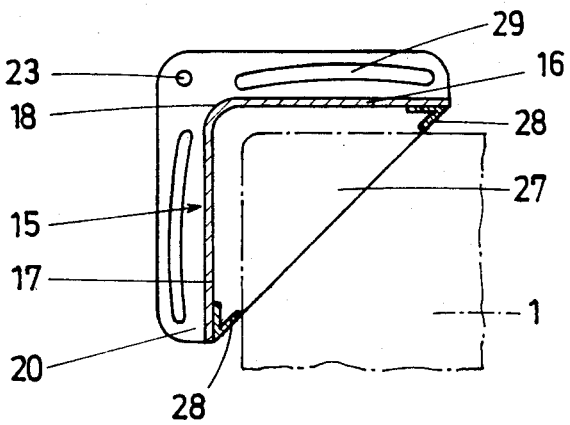
FIG. 5 is a section along the line V—V of FIG. 3.
Figure 6:
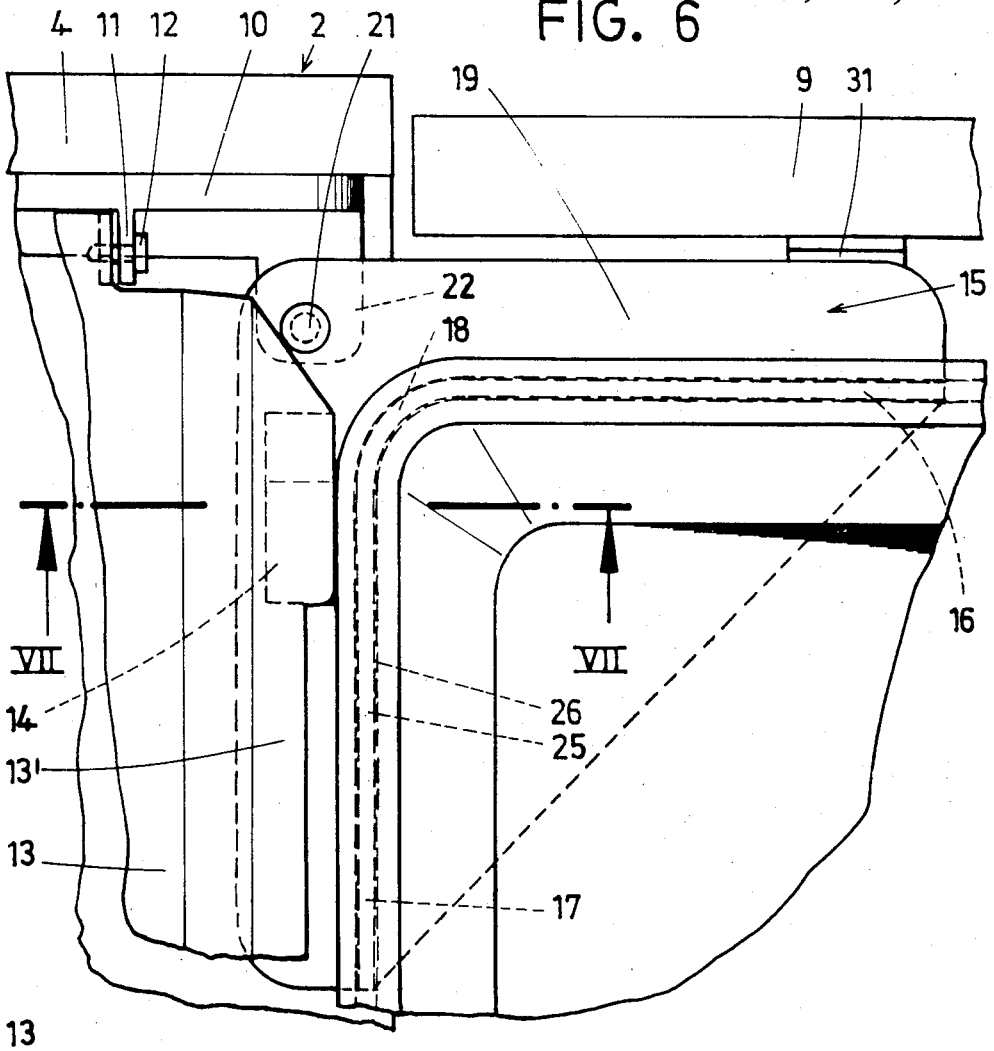
FIG. 6 shows, in approximately true size, a horizontal section through the cabinet above the trash pail, only part of which is shown.
Figure 7:
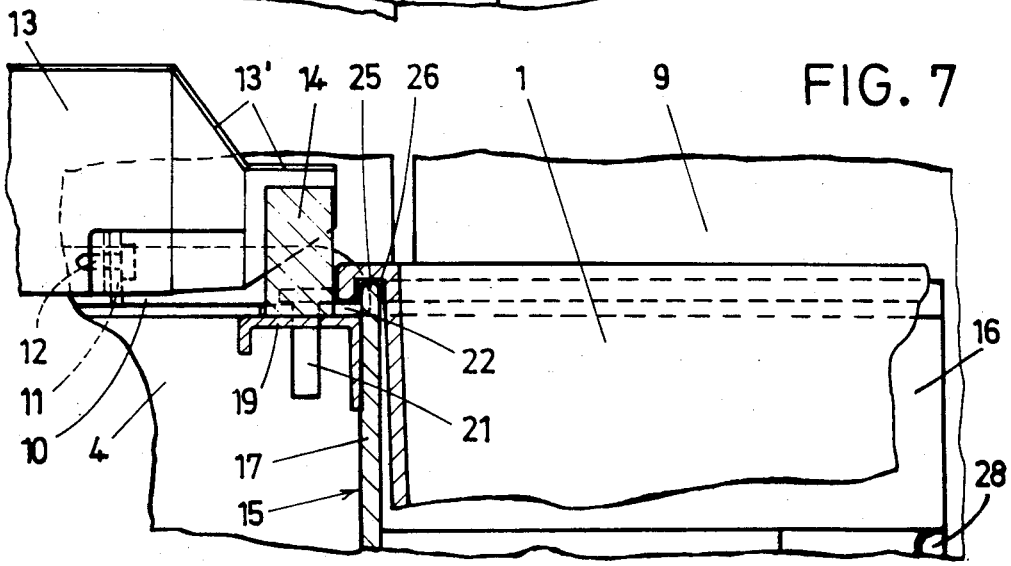
FIG. 7 is a section along the line VII—VII of FIG. 6.
Figure 8:
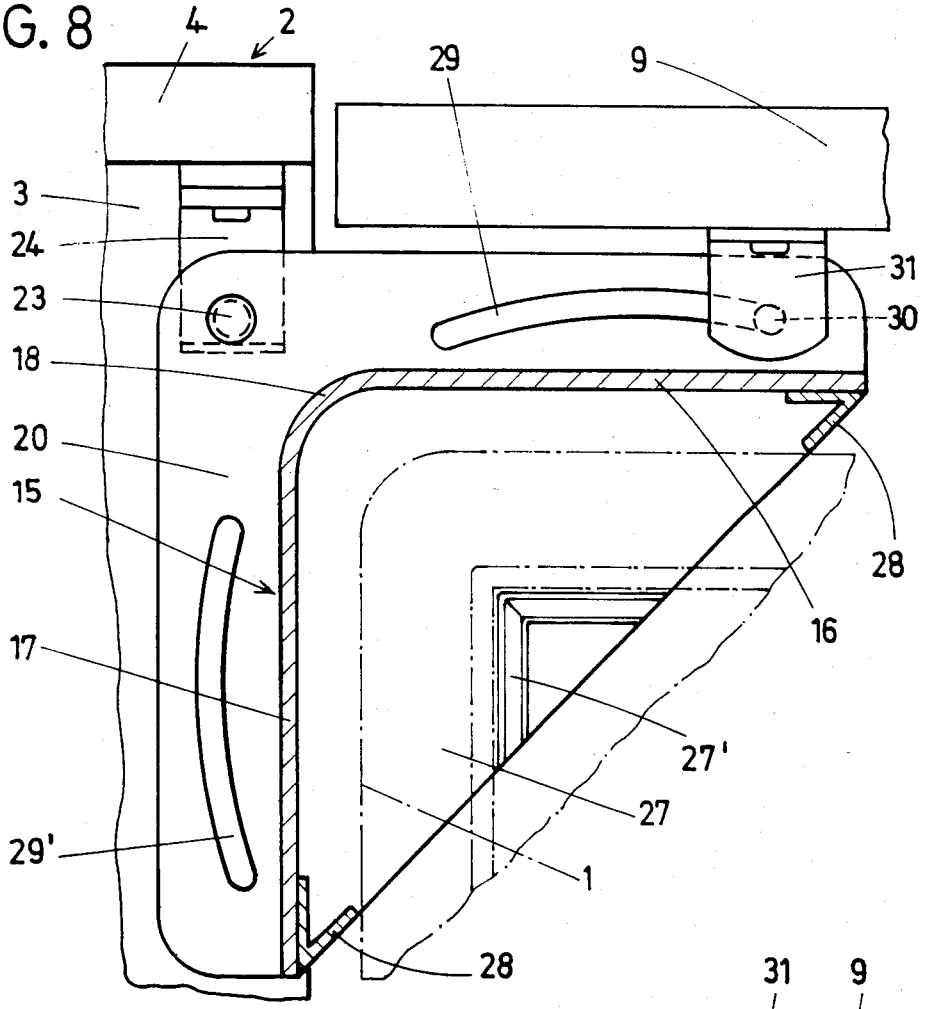
FIG. 8 is a horizontal section through the angle iron, with the door open.
Figure 9:
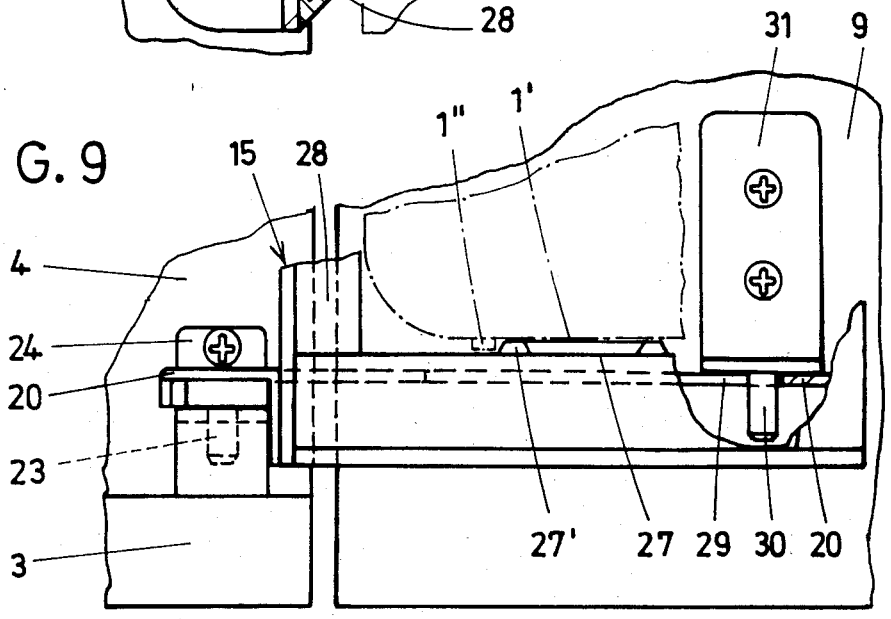
FIG. 9 is a view looking at the lower part of the angle iron, partially broken away, with the door open.
Figure 10:
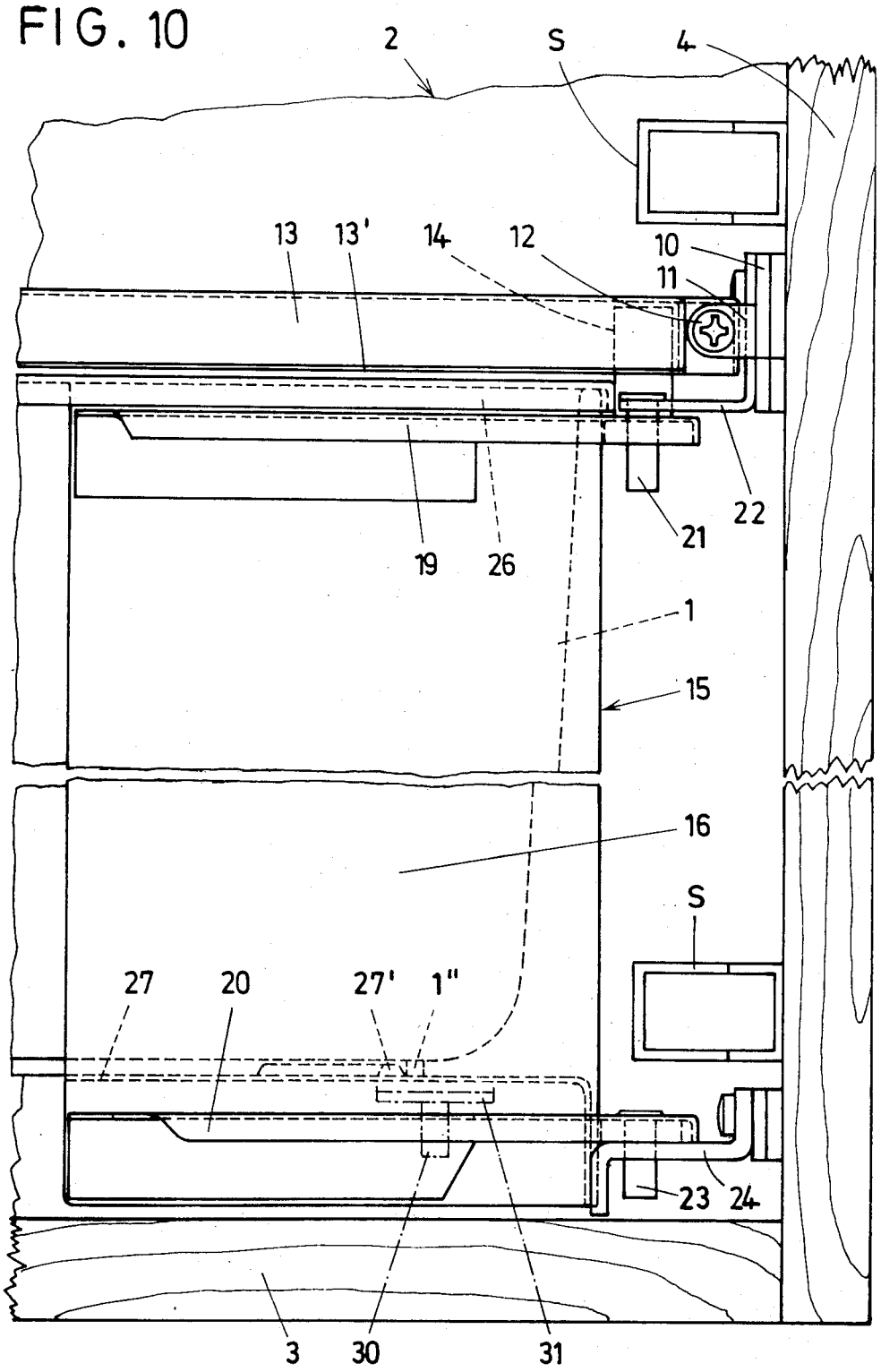
FIG. 10 is a view looking at the angle iron plus trash pail in the position assumed when the door is closed.

To the inner surface of the cabinet wall 4, just below the mask 8, there is fastened a horizontally directed ledge 10 which bears, on sidebars 11 arranged at right angles to the cabinet wall 4, a lid 13 which is swingable around a horizontal axis 12. The rim 13′ of the lid, which has two bends, cooperates with a cam projection 14 which extends from an angle iron 15 which forms the support for the trash pail 1. In detail, the angle iron 15 consists of two vertically directed arms 16 and 17 the vertex 18 between which is rounded. In this way an approximately triangular angular space is produced which is adapted, in the embodiment shown, to the rectangular cross sectional shape of a part of the trash pail 1. The latter is associated with the angle iron 15 in the manner that its longer lengthwise axis extends parallel to the door 9; see in particular FIG. 2.

The angle iron 15 is provided at its upper and lower ends with collars 19, 20, respectively, which project in a direction away from the angular space formed between the arms 16, 17 of the angle iron 15. The crown a direction away from the angular space formed by the arms 16, 17 of the angle iron 15. The vertex of the upper collar 19 is passed through by a pivot pin 21 which engages into a sidebar 22 on the ledge 10. In the direct vicinity of the pivot pin 21 there is a cam projection 14 which is fastened to the collar 19 and extends above it, which projection, when the door 9 is in the open position, has swung the lid 13 through a given angle in upward direction.

The lower collar 20 also bears a pivot pin 23. The two pivot pins 21, 23 are aligned on the same axis. The lower pivot pin 23 is rotatably seated in a supporting sidebar 24 which is screwed to the cabinet wall 4.

The arms 16, 17 of the angle iron 15 extend a certain distance above the upper collar 19. This protruding end edge 25 engages in form-locked manner into a groove 26 provided in the upper rim of the trash pail 1, fixing the suspended position of the trash pail. In this suspended position the pail bottom 1′ rests, via a collar 1″, on a bottom plate 27 which plate corresponds to the angular cross section. This plate extends somewhat above the lower collar 20; it is connected to the arms 16, 17 and, for better holding of the lower region of the trash pail, is equipped with an outwardly directed rib 27′ which engages behind the pail bottom collar 1″. Even if the rib 27′ were absent, sufficient support of the inserted trash pail 1 is assured by the fact that a portion of the outer surface of the trash pail rests against the angle iron. For this purpose there are provided angularly bent ledges 28 which extend from the side edges of the arms 16, 17 of the angle iron 15. The corresponding ledges widen in downward direction, corresponding to the conical shape of the trash pail 1.

In connection with the illustrative embodiment it has been mentioned that the trash pail 1 is associated in hanging fashion with the angle iron 15 in the manner that the edge of the pail comes into form-locked engagement with the end edge of the angle iron 15. However, it would also be possible to develop the ledges 28 and the pail within the corresponding angular region in such a manner as to produce a form-lock between said ledges and the pail.

In order that, upon the opening of the door 9, the angle iron 15 is moved out of the cabinet with the trash pail 1 supported by it, a coupling engagement is provided between door 9 and angle iron 15. For this purpose, the lower collar 20 has an arcuate slot 29 in the arm thereof adjacent the door 9. A pin 30 fastened to an angular side strap 31 of the door 9 engages in said slot.

Upon the opening of the door 9, the angle iron 15 is accordingly swung out of the cabinet, the trash pail 1 coming into the position which is accessible from the outside. Upon this swinging of the angle iron 15, the cam projection 14 acts on the rim 13′ of the lid and swings the lid 13 around its horizontal axis 12 up into its open position. The lid rests in this position on the cam projection 14. It is possible to move the lid further upward as a result of the free motion of the lid. If the door 9 is closed, the angle iron 15 is positively swung into the cabinet, its cam projection 14 moving away from the lid rim 13′ and accordingly permitting the closing of the lid by gravity.

In order to be able to fasten the same angle iron 15 both on the right and on the left, the other arm of the collar 20 also has a corresponding arcuate slot 29′. The drive pin 30 would then engage in it. Similarly, the cam projection 14 would be associated with the other arm of the angularly bent collar 19.

In the embodiment shown the trash pail 1 has a rectangular contour. However, it could also be circular. An oval cross-sectional shape is also possible. The fillet of the angle iron is to be developed in accordance with the corresponding shape of the pail.

What is claimed is:

1. In a system comprising a trash pail for installation in a cabinet having a cabinet wall and swingable door, the improvement comprising a support, the trash pail being removably suspended in a vicinity of an upper edge thereof on said support, said support being pivotally fastened to said cabinet wall around a vertical axis and operatively coupled to said door, the pail, upon turning the support around said vertical axis upon opening the door, being swung out from inside of the cabinet, said support comprises an angle member having two arms, said arms extend horizontally substantially 90° with respect to each other forming an angular space with respect to each other, said trash pail is formed with a corner part of a wall surface of the trash pail, said corner part being of non-circular plan cross section and being supported within said angular space against said arms complementarily form-locking said trash pail thereon said upper edge of said trash pail forms a rim, said angle member has as upper end edge of said arms of said angle member, the rim of the trash pail is removably suspended over the upper end edge of said arms of said angle member forming said complementary form-locking.

2. The trash pail according to claim 1, further comprising a lid hinged to said cabinet wall pivotally about a horizontal axis, said lid having a bent rim, said support is pivotal about said vertical axis swinging out from and respectively into the inside of the cabinet carrying said trash pail therewith when said door is swung, said angle member comprising an upper end edge and a cam projection, said cam projection being adjacent the upper end edge of the angle member adjacent said vertical axis, said cam projection, upon the swinging of the angle member, moves against and under the rim of the lid so as to pivot said lid about said horizontal axis.

3. The trash pail according to claim 1, wherein said trash pail further comprising an elongated shape in plan defining a longer axis of length extending parallel to the door.

4. The trash pail according to claim 1, further comprising a lid for the trash pail pivotally mounted to said cabinet wall, said arms of said angle member have at least one collar, said collar projects in a direction away from the angular space, said collar forming a cam projection means for pivoting said lid up when said door is opened, and a slot-pin connection means cooperatively on said collar and door for the operative coupling of said support with the door.

5. The trash pail according to claim 4, wherein said arms of said angle member extend vertically, an upper of said at least one collar being disposed at an upper end of said angle member and forming said cam projection means, and a lower of said at least one collar being disposed at a lower end of said angle member and forming a cooperating part of said slot-pin connection means, and said lower end engages a bottom portion of said trash pail.

6. The trash pail according to claim 1, wherein said angle member has a rounded vertex where said arms meet bounding the angular space, said vertical axis passes through said angle member adjacent said vertex.

7. The trash pail according to claim 1, wherein said arms have ledges adjacent free ends of said arms and extend into said angular space, said ledges are bent at an angle in a direction towards the wall surface of the trash pail, said ledges widen in downward direction engaging the wall surface of the trash pail.

8. The trash pail according to claim 7, wherein said trash pail tapers narrowing toward a bottom thereof.

9. The trash pail according to claim 1, wherein said trash pail tapers narrowing toward a bottom thereof.

* * * * *